US007290502B2

(12) United States Patent
Kidd et al.

(10) Patent No.: US 7,290,502 B2
(45) Date of Patent: Nov. 6, 2007

(54) SYSTEM AND METHODS FOR CONTROLLING A WATER HEATER

(75) Inventors: Larry D. Kidd, Florence, SC (US); R. Dale Shropshire, Hartsville, SC (US); John S. Haefner, St. Louis, MO (US); G. Scott Vogel, Fenton, MO (US)

(73) Assignee: Emerson Electric Co., St. Louis, MO (US)

( * ) Notice: Subject to any disclaimer, the term of this patent is extended or adjusted under 35 U.S.C. 154(b) by 480 days.

(21) Appl. No.: 11/052,307

(22) Filed: Feb. 7, 2005

(65) Prior Publication Data

US 2006/0174846 A1 Aug. 10, 2006

(51) Int. Cl.
*F24H 9/20* (2006.01)

(52) U.S. Cl. ..... 122/14.2; 122/14.21

(58) Field of Classification Search ..... 122/14.2, 122/14.1, 14.21, 14.3, 14.31
See application file for complete search history.

(56) References Cited

U.S. PATENT DOCUMENTS 3,782,881 A * 1/1974 Feeney ..... 431/90
3,887,325 A * 6/1975 Finger et al. ..... 431/6
4,581,697 A * 4/1986 Jamieson et al. ..... 700/11
5,797,358 A 8/1998 Brandt et al. ..... 122/448.1
6,053,130 A * 4/2000 Shellenberger ..... 122/14.21
6,345,769 B2 * 2/2002 MacIntyre ..... 237/8 R
RE37,745 E 6/2002 Brandt et al. ..... 122/14.2
6,662,757 B2 * 12/2003 Lesage ..... 122/14.21
6,766,771 B1 7/2004 Hotton ..... 122/142
6,877,462 B2 * 4/2005 Adams et al. ..... 122/14.1
7,032,543 B1 * 4/2006 Akkala et al. ..... 122/14.31

* cited by examiner

*Primary Examiner*—Gregory Wilson
(74) *Attorney, Agent, or Firm*—Harness, Dickey & Pierce, P.L.C.

(57) ABSTRACT

A control for a water heater is provided that comprises a pressure switch for sensing a predetermined level of airflow sufficient for maintaining proper burner operation, and a temperature sensing means for sensing the temperature of the water in the tank. The control further comprises a processor for controlling the operation of the burner to maintain the water temperature above a predetermined value. When the processor receives a signal from the pressure switch indicating an insufficient level of airflow, the processor shuts down the burner and subsequently attempts to restart the burner. The processor will also lock-out further burner operation after a predetermined number of consecutive shut downs occurs before the water is heated to a desired temperature during a single call for heating.

9 Claims, 4 Drawing Sheets

SYSTEM AND METHODS FOR CONTROLLING A WATER HEATER

FIELD OF THE INVENTION

The present invention relates generally to power-vented gas water heaters and, more particularly, to the control of a power vent water heater.

BACKGROUND OF THE INVENTION

In gas-fired water heater applications, flame arrestors are commonly used to restrict propagation of the burner flame through an air inlet to flammable vapors that may be present outside the appliance. In residential water heaters having flame arrestors, lint or other substances may restrict air flow through the flame arrestor and cause insufficient air flow to the burner or an elevated flue temperature. Commercial water heaters, which typically have a power-vented means for exhausting combustion air from the burner, may also experience the same restriction of air flow through a flame arrestor. When airflow becomes restricted to the point that a pressure switch subsequently opens, the water heater burner will shut off. The water heater would restart the burner again and encounter the same problem, which would lead to the repeated cycling of burner operation.

SUMMARY OF THE INVENTION

The present invention is directed to a gas-fired water heater having a burner that heats water in a tank, and a flame arrestor in an air inlet to the burner. In one embodiment, the water heater includes a control that comprises a pressure switch for sensing a predetermined level of airflow sufficient for maintaining proper burner operation, and a water temperature sensing means for sensing the temperature of the water in the tank. The control further comprises a processor connected to the water temperature sensing means and connectable to the burner for controlling the operation of the burner for heating the water in the tank to a desired temperature. The processor is further connected to the pressure switch to receive a communication from the pressure switch indicating a burner shut down resulting from an insufficient level of airflow. The processor discontinues burner operation when a predetermined number of consecutive shut downs resulting from insufficient airflow occurs before the water is heated to a desired temperature.

In a second embodiment of the invention, the water heater control comprises a temperature switch that opens upon sensing a flue temperature above a predetermined temperature, and a processor for controlling the operation of the burner. The processor is further connected to the temperature switch to receive a communication from the temperature switch indicating a burner shut down resulting from an elevated flue temperature, wherein the processor discontinues burner operation when a predetermined number of consecutive shut downs in which the burner is shut down for more than a predetermined time occurs before the water is heated to the desired temperature.

In a third embodiment of the invention, the water heater includes a control that comprises a pressure switch that opens upon sensing at least a predetermined level of airflow, and a temperature switch that opens upon sensing a flue temperature above a predetermined temperature. The control further comprises a processor further connected to the temperature switch to receive a communication from the temperature switch indicating a burner shut down resulting from an elevated flue temperature, and connected to the pressure switch to receive a communication from the pressure switch indicating a burner shut down resulting from an insufficient level of airflow. The processor locks out further burner operation after either a first predetermined number of consecutive shut downs occur in which the burner is shut down within a predetermined time of initiating burner operation, or after a second predetermined number of consecutive shut downs in which the burner is shut down for more than a predetermined time as a result of an open temperature switch.

Further areas of applicability of the present invention will become apparent from the detailed description provided hereinafter. It should be understood that the detailed description and specific examples, while indicating embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Corresponding reference numerals indicate corresponding parts throughout the several views of the drawing.

DETAILED DESCRIPTION OF THE EMBODIMENTS

The following description of embodiments of the invention is merely exemplary in nature and is in no way intended to limit the invention, its application, or uses.

Figure 1:
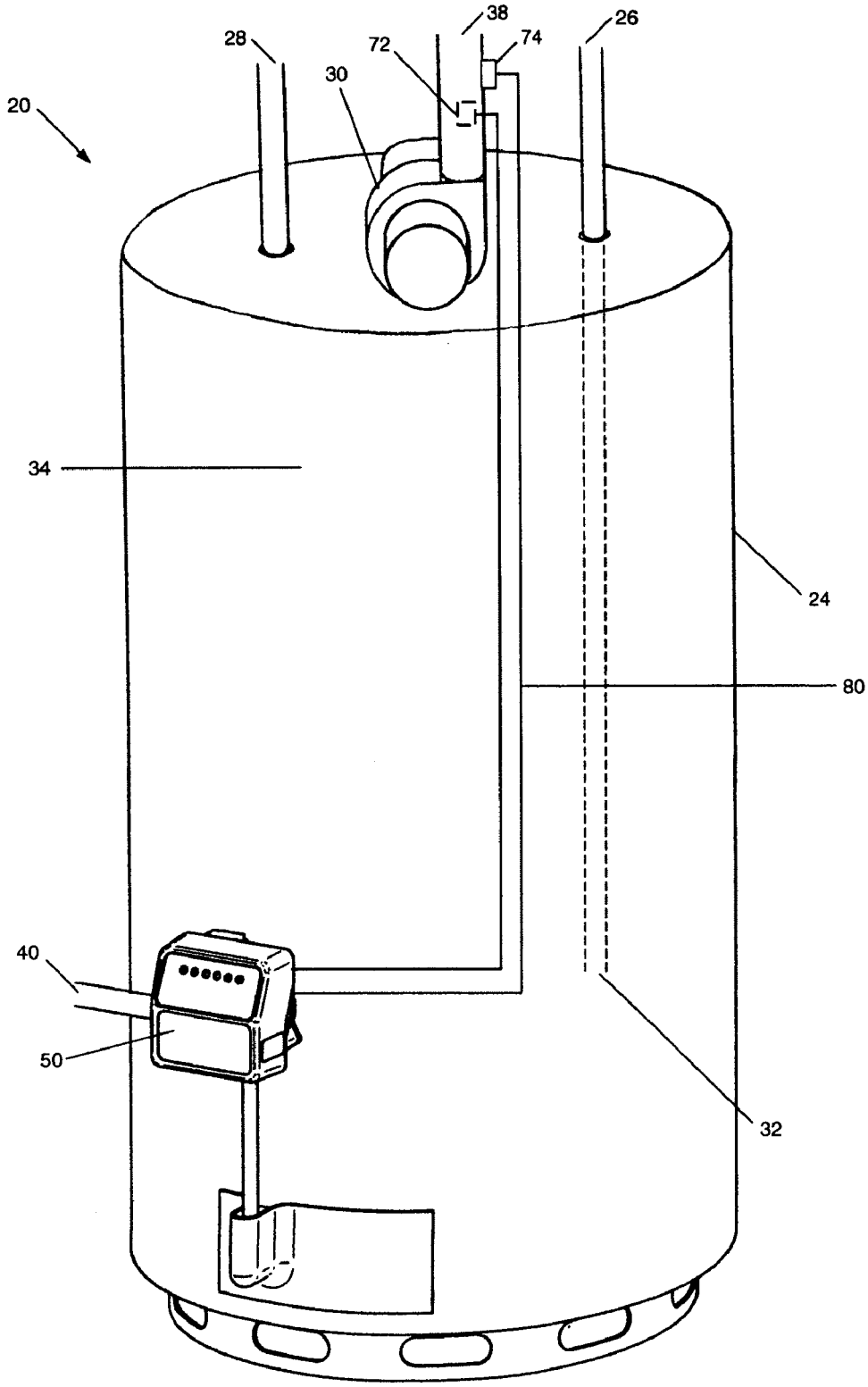
FIG. 1 is a perspective view of a water heater according to one embodiment of the present invention.

A gas water heater according to one embodiment of the present invention is indicated generally by reference number 20 in FIG. 1. The heater 20 has a tank 24 into which cold water enters via a cold water inlet pipe fitting 26. Cold water entering the bottom 32 of the tank is heated by a gas burner 848 (FIG. 4) beneath the tank. The burner can be lighted, for example, using an igniter 58 (shown schematically in FIG. 2). Heated water rises to the top 34 of the tank 24 and leaves the tank via a hot water pipe 28. Combustion gases leave the water heater via a flue 38 and a blower 30 that provides ventilation of combustion gases through the flue 38. An electrically operated gas valve 60 is preferably enclosed within the controller 50 shown in FIG. 2, and controls gas flow through a gas supply line 40 to the burner. It should be noted that the gas valve may alternatively be separate from the controller 50 in other embodiments of the present invention, and the scope of the invention is not limited to the example of the various embodiments as further described below.

Figure 4:
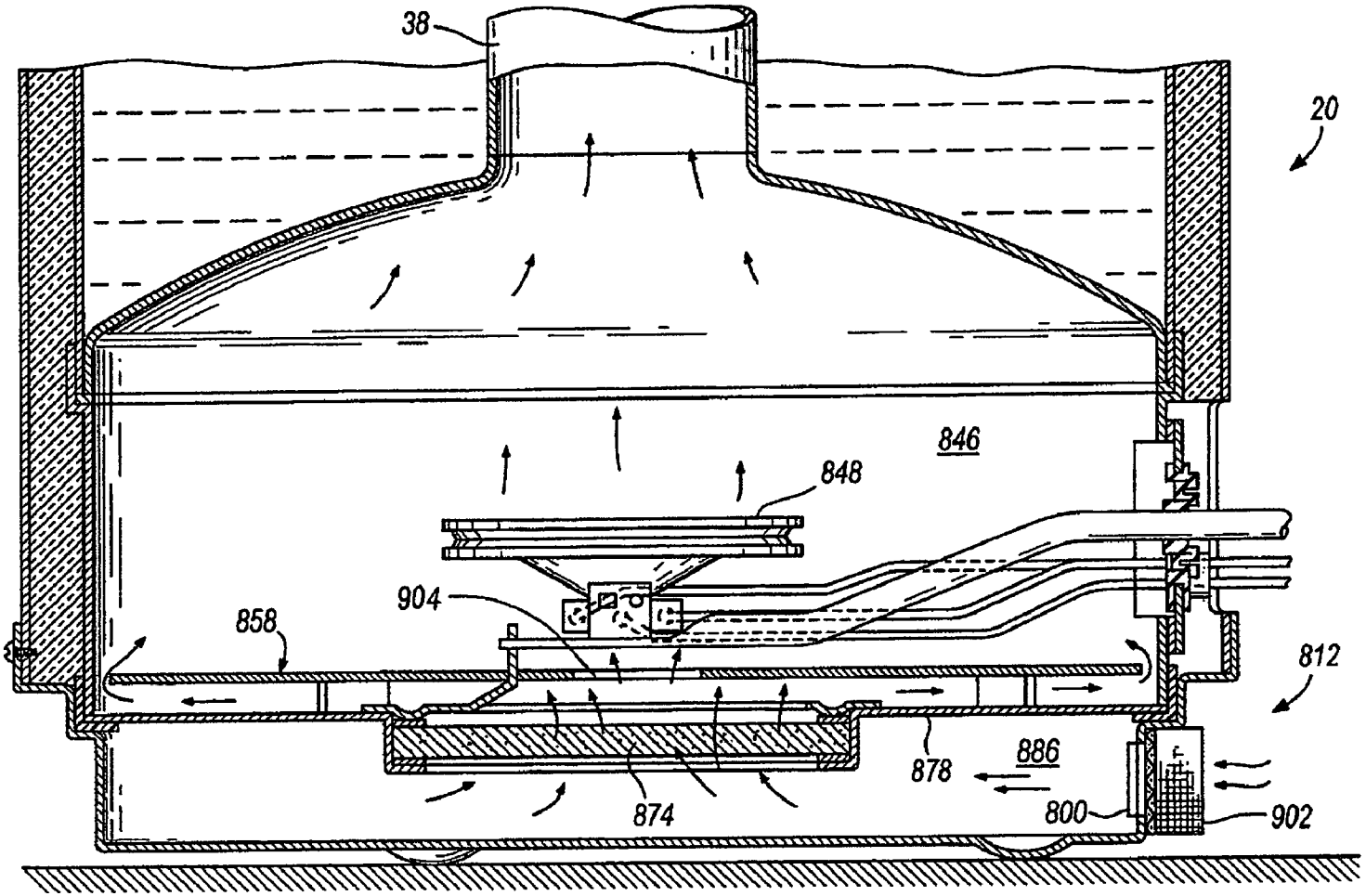
FIG. 4 is a sectional view of the bottom portion of the water heater.

The bottom of the water heater 20 is shown in greater detail in FIG. 4. The water heater 20 includes a base pan 812 supporting the water tank 24. The base pan 812 may be constructed of stamped metal or plastic. The bottom of the water heater 20 defines a combustion chamber 846 having therein the gas burner 848. The water heater 20 includes a radiation shield 858, a flame arrestor 874, a flame arrestor support 878 and a plenum 886.

The flame arrestor 874 permits substantially all flammable vapors that are within flammability limits to burn near its top surface while preventing substantially all flames from passing from the top surface, through the flame arrestor 874, out the bottom surface, and into the plenum 886. The flame arrestor 874 is constructed of materials that resist thermal conduction from the upper surface to the lower surface to further reduce the likelihood of ignition of flammable vapors in the air plenum 886.

The base pan 812 is configured to provide the primary structural support for the rest of the water heater 20. The base pan 812 and the flame arrestor support 878 together define the air plenum 886. The base pan 812 includes an air intake aperture or air inlet 800 to the air plenum 886. The air inlet 800 is covered by a screen 902. The screen 902 is positioned upstream of the flame arrestor 874, and is made of a wire mesh material that acts as a lint or bug screen so that undesired objects or particles are not allowed to enter the plenum 886 leading to the combustion space. The screen 902 filters the great majority of airborne particles that may interfere with the operation of the flame arrestor 874. Without the screen 902, particles would accumulate on the flame arrestor 874, and could possibly cause flare-ups on the bottom surface of the flame arrestor if the debris caught fire. Such buildup in debris could also restrict the amount of air flowing through the flame arrestor 874, thereby interfering with combustion.

As indicated by the arrows in FIG. 4, air flows through the screen 902, into the plenum 886, through the flame arrestor 874, and around the radiation shield 858 or through apertures 904 in the radiation shield 858. Substantially all of the air that is necessary for combustion must pass through the flame arrestor 874. The hot products of combustion rise up through the flue 38, and heat the water by convection and conduction through the flue 38.

Other features of the lower portion of the water heater 20 are preferably the same as disclosed in U.S. Pat. Nos. 6,216,643 and 6,295,952, both of which are incorporated herein by reference.

A system for controlling the water heater 20 includes a controller 50 positioned, for example, adjacent the tank 24. As further described below, the controller 50 is configured to sense flammable vapors, air flow through the burner, the flue temperature, and the water temperature in the tank 24. The controller 50 also can responsively activate or deactivate the igniter and the gas valve, as further described below.

Figure 2:
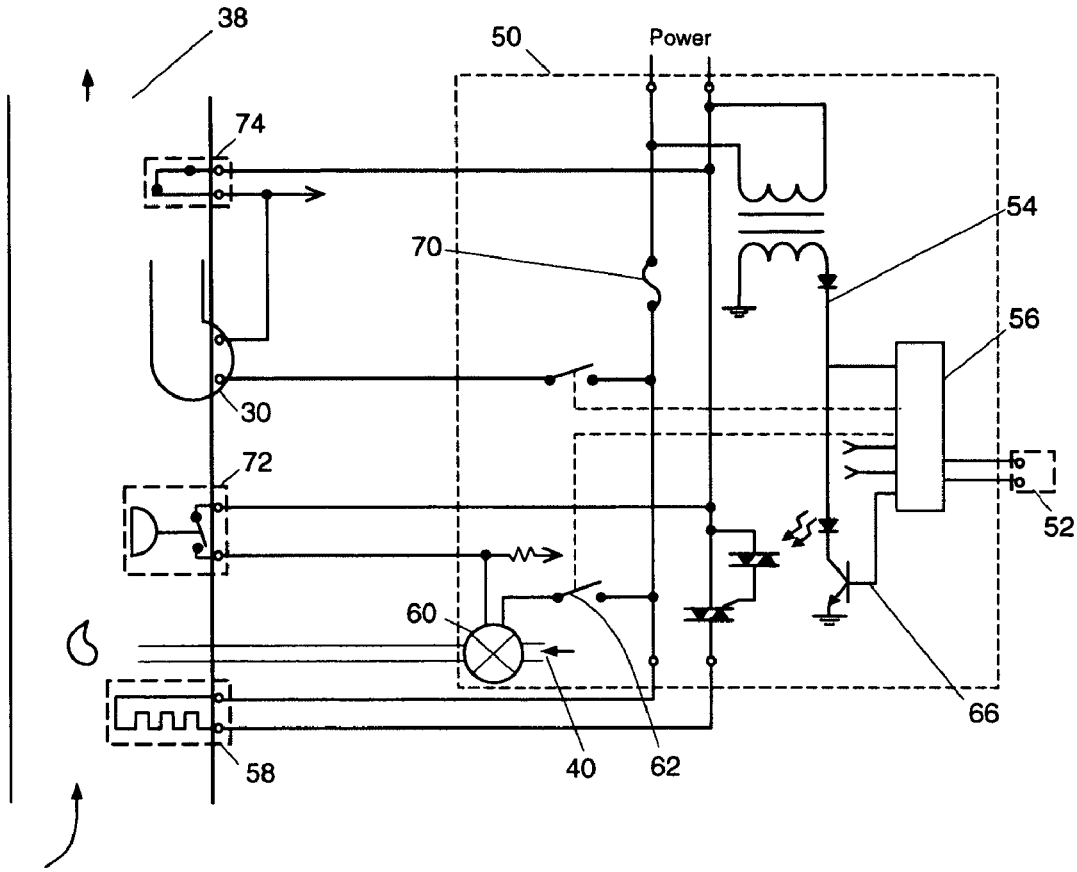
FIG. 2 is a schematic diagram of a water heater controller according to one embodiment of the present invention.

Referring to FIG. 2, a water temperature sensor 52 connected to the controller 50 senses a temperature having a relation to the temperature of the water inside the tank. For example, the sensor 52 may be a tank surface-mounted temperature sensor or the like. However, other embodiments of the invention can alternatively use a temperature probe or other sensor suitable for enabling sensing the water temperature in the tank. To prevent scalding, the controller 50 can shut off the water heater 20 in FIG. 1 if the water temperature sensor 52 senses a temperature exceeding a predetermined maximum value.

The control preferably comprises a low voltage power supply circuit 54 that provides operating power to a processor 56, e.g., a microprocessor that receives input from the water temperature sensor 52 and controls activation of the igniter 58 and gas valve 60. It should be noted that the processor 56 in the this embodiment comprises a microprocessor chip having memory internal to the device. However, the processor may also suitably comprise a separate memory chip in communication with the processor, and should not be limited in scope to the microprocessor of this embodiment. A low voltage, e.g. 5 VDC, power supply is provided to enable the processor 56 and other circuitry to control heater operation. Other voltages for the processor 56 and/or power supply 54 are possible in other configurations. In this first embodiment, the power supply is preferably a small transformer and diode circuit.

The processor 56 controls at least one gas valve actuator, and in the present invention, controls an actuator 62 for operating the electrically operated gas valve 60. The processor 56 also controls an igniter actuator 66 for operating the igniter 58. A thermal fuse 70 interrupts the supply of power if the water temperature exceeds a predetermined upper limit. Thus, the fuse 70 serves as a backup for the water temperature sensor 52 to prevent excessively high water temperatures.

The controller 50 monitors temperature change as signaled by the sensor 52. If the controller 50 determines, for example, that the water temperature has dropped below a predetermined temperature, the controller 50 establishes a call for heat as further described below.

The controller 50 appropriately establishes a call for heat in response to sensing a condition indicating a need for heating, such as a water temperature that is below a predetermined temperature value, for example. The processor 56 subsequently controls switching of power to the blower 30, then to the igniter 58, followed by initiating the flow of gas through the gas valve 60 to establish burner operation. As long as the water temperature remains below a desired predetermined temperature value at which the call for heat is terminated, the call for heat will continue and the burner will continue to raise the water temperature. In one embodiment of the present invention, the desired or predetermined temperature value for terminating a call for heat is preferably at least 120 degrees Fahrenheit. The processor 56 uses input from the water temperature sensor 52 to determine whether the predetermined temperature value for terminating a call for heat has been reached, at which point the processor 56 ends the call for heat.

The controller 50 is configured to sense air flow to the burner through a pressure switch 72. The pressure switch 72 closes when sensing a predetermined level of airflow sufficient for maintaining proper burner operation. The pressure switch 72 is connected in series with the gas valve 60, such that the opening of the pressure switch 72 interrupts power to the gas valve 60 to cause the gas valve 60 to close. The processor 56 is also in communication with the pressure switch 72, as shown in FIG. 2. The processor 56 is thus capable of detecting when the pressure switch 72 senses a value indicative of air flow insufficient for proper burner operation. The minimum level of airflow for proper operation is preferably that at which combustion produces less than 0.04 percent of carbon monoxide in the flue gases. The pressure switch 72 is adapted to sense a restricted air flow that will produce at least 0.04 percent of carbon monoxide during combustion operation. For example, in this embodiment the pressure switch 72 is a pressure switch that directly senses the pressure of the combustion air flow. In other embodiments, the pressure switch 72 comprises an analog pressure sensor, which may be adapted to indirectly sense restricted air flow at the inlet, flue, or other appropriate location.

In the first embodiment, the controller 50 is also configured to sense the temperature of the flue gas through a temperature cutout switch 74. Other embodiments, however, may employ a temperature sensor or a thermistor to appropriately sense the temperature of the flue gas. An increase in the flue exhaust temperature is also indicative of an insufficient air flow to the burner. The temperature switch 74 is preferably connected to the processor 56 in a manner such that the processor can monitor when the temperature switch 74 opens. The temperature switch 74 may also be placed in series with the power vent blower motor, such that a flue gas temperature above a predetermined value will cause the switch to open and interrupt power to the blower to shut off air flow. Shutting off the blower will also cause the pressure switch 72 to open and the gas valve to close. The processor 56 can therefore also indirectly sense the opening of the temperature switch 74 through the opening of the pressure switch 72. It is also envisioned that in another embodiment the temperature switch 74 is placed in series with the gas valve, such that a flue gas temperature above a predetermined value will cause the switch to open and interrupt power to the gas valve.

Figure 3:
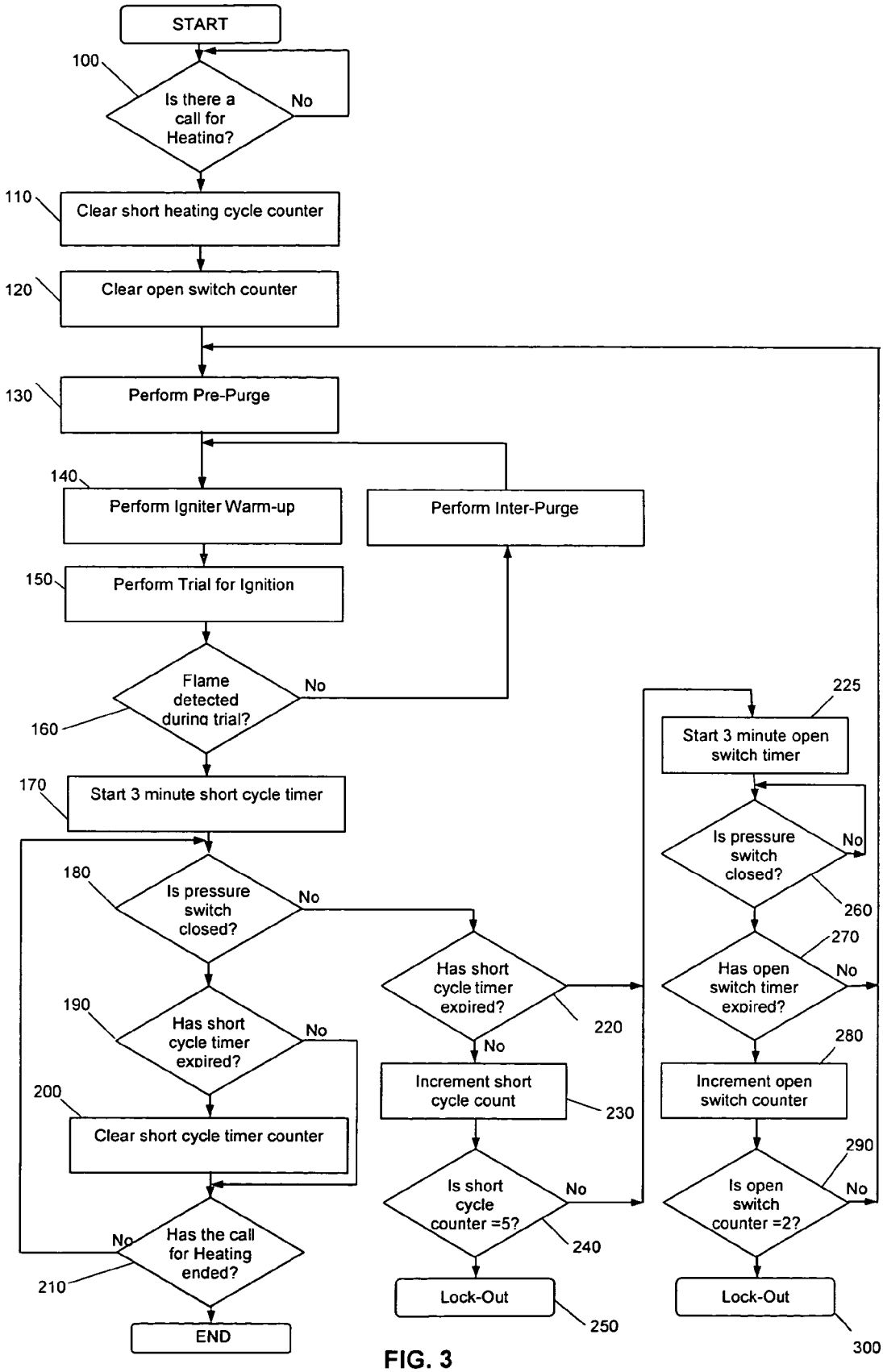
FIG. 3 is a flow chart of the operation of a water heater controller according to one embodiment of the present invention.

In operation, the processor 56 monitors the pressure switch 72 and/or the temperature switch 74 to control the operation of the burner. One example method of operation is illustrated in FIG. 3 where the processor 56 monitors the pressure switch 72 to control the operation of the burner. However, it should be understood that the processor 54 can monitor the temperature switch 74, or some other parameter, similar to the monitoring of the pressure switch illustrated in FIG. 3. The processor 56 preferably comprises a software program for controlling the operation of the burner for heating the water in the tank. The processor 56 first evaluates whether the sensed water temperature 52 is below a predetermined temperature value to determine whether a call for heat is required at step 100. When the processor 56 initiates a call for heat at step 100, the software program proceeds to clear a stored short cycle counter value and an open switch counter value at steps 110 and 120. The blower 30 is then turned on at step 130 to purge combustion air and initiate the supply of air to the burner. In normal operation, the blower ramps up to speed to cause the pressure switch 72 to close. The program then begins the igniter warm up steps at 140 and 150. The processor 56 checks a flame sensor to determine whether a burner flame has been established at step 160. After a flame has been established, the burner operates normally to heat the water in the tank to the desired temperature.

Once a flame has been established, the control also monitors the pressure switch 72 to ensure sufficient airflow is present for proper burner operation. Upon establishing flame, the program begins a short cycle timer period of a first predetermined time period at step 170. In one embodiment, the first predetermined timer period is about three minutes, but may be any time period sufficient to monitor a short burner cycle due to a shut down. If the water heater is functioning normally, the pressure switch 72 remains closed and the burner continues to heat the water until the call for heat ends at step 210. If at any time the processor 56 detects an open pressure switch at step 180, the program determines whether the short cycle timer period has expired at step 220. If the program determines the pressure switch 72 opened before the three minute short cycle timer period expired at step 220, the program will increment a short cycle counter at step 230 from the default zero value to a value of one. Since the short cycle counter value is not equal to five at step 240, the program starts an open switch timer at step 225 and checks whether the pressure switch is closed at step 260.

It should be noted that when the pressure switch 72 has opened at step 180, the program is still calling for operation of the blower even though electrical power to the gas valve is interrupted by the pressure switch to shut off the burner. Thus, the blower could still be running at step 260, and the pressure switch may re-close after the burner has shut off. However, a restriction at the air inlet could lead to insufficient airflow and cause the flue temperature to gradually increase and open the temperature switch 74, which interrupts power to the blower motor and causes the pressure switch 72 to open. Thus, the blower could also be off at step 260. The temperature switch 74 would continue to interrupt power to the blower until the flue temperature has cooled enough for the temperature switch 74 to close again. Thus, the blower 30 will remain off for at least a predetermined time period while the flue temperature cools. For this reason, the program will monitor an open switch timer of a predetermined time period at step 225. The open switch timer period in this embodiment is about three minutes, but may be any time period sufficient to monitor the opening of the temperature switch 74 after a restriction of air flow causes the flue temperature to elevate to a threshold temperature, which is in the range of about 300° Fahrenheit to about 460° Fahrenheit depending on the heater application.

If the pressure switch 72 opens at step 180 (shutting down the burner) and subsequently closes again at step 260 before the open switch timer expires at step 270, the program will return to step 130 to initiate a pre-purge and request a restart of burner operation at steps 140 and 150. Once a flame has been established at step 160, the control again monitors the pressure switch 72 to ensure sufficient airflow is present for proper burner operation. If at step 180 the processor 56 detects the pressure switch 72 has opened again before the three minute short cycle timer period expired at step 220, the program will increment the short cycle counter at step 230 from a value of one to two and restart the burner. If this open pressure switch failure occurs repeatedly, the program will continue to increment the short cycle counter at step 230. If five consecutive occurrences of the pressure switch opening within the three minute short cycle time period transpires before the water temperature is raised to the desired temperature, the short cycle counter will increment to five and the program will initiate a lock-out of further burner operation at step 250.

If the pressure switch 72 opens at step 180 (shutting down the burner) and subsequently closes again at step 260 after the three minute open switch timer has expired at step 270, the program will increment the open switch counter at step 280. The open switch counter would be incremented from a default zero value to a value of one. Since the open switch counter is less that two at step 290, the program will return to step 130 to initiate a pre-purge and request a restart of burner operation at steps 140 and 150. If upon establishing flame the pressure switch opens again at step 180 after the three minute short cycle timer period expires at step 220, the program starts the open switch timer at step 225. If the pressure switch 72 does not close at step 260 until after the three minute open switch timer period expires at step 270, the program will increment the open pressure switch counter at step 280 from the value of one to two. When two consecutive occurrences of the pressure switch opening after the three minute open switch timer has expired (at step 290), the program will initiate a lock-out of further burner operation at step 300. Thus, the control is adapted to monitor the temperature switch 74 through the opening of the pressure switch 72, to ensure sufficient airflow is present for proper burner operation.

In another embodiment of the present invention, the controller 50 may be connected to the temperature switch 74 via a wire 80 (shown in FIG. 1). The program could then determine by the connection via wire 80 when the temperature switch 74 is open before step 220, and immediately increment the open switch counter 280 based on the open temperature switch 74. This would eliminate the need to monitor the time that the pressure switch 72 is open at step 270, since the temperature switch 74 would be directly monitored by the processor 56.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A control for a gas-fired water heater appliance having a flame arrestor in the air inlet to a burner, the appliance comprising:

a pressure switch that closes to complete a circuit in the control when sensing a predetermined level of airflow sufficient for maintaining proper burner operation, wherein the level of air flow sufficient for maintaining proper burner operation produces less than 0.04 percent of carbon monoxide in the flue gases;

a water temperature sensor; and a processor connected to the water temperature sensor and connectable to the burner for controlling the operation of the burner for heating the water in the tank to a desired temperature, the processor being further connected to the pressure switch to receive a communication from the pressure switch indicating a burner shut down resulting from an insufficient level of airflow, wherein the processor discontinues burner operation after the occurrence of a predetermined number of shut downs before the water is heated to the desired temperature, in which shut downs the burner is shut down within a predetermined time of initiating burner operation as a result of an open pressure switch.

2. The control of claim 1 wherein the predetermined number of consecutive shut downs is five shut downs.

3. A control for a gas-fired water heater appliance having a flame arrestor in the air inlet to the burner, the appliance comprising:

a pressure switch that closes upon sensing at least a predetermined level of airflow;

a temperature switch that opens upon sensing a flue temperature above a predetermined temperature; and a processor for controlling the operation of the burner for heating the water in the tank to a desired temperature, the processor being further connected to the pressure switch and the temperature switch to sense burner shut down resulting from opening of either the temperature switch or pressure switch, wherein the processor discontinues and locks out further burner operation after the occurrence of a predetermined number of shutdowns before the water is heated to the desired temperature, in which shut downs the burner is shut down for more than a predetermined time period as a result of an open temperature switch wherein the predetermined number of consecutive shut downs is two shut downs, and the predetermined time period is in the range of about 150 seconds to about 210 seconds.

4. A control for a gas-fired water heater appliance having a flame arrestor in the air inlet to the burner, the appliance comprising:

a pressure switch that closes upon sensing at least a predetermined level of airflow;

a temperature switch that opens upon sensing a flue temperature above a predetermined temperature; and a processor for controlling the operation of the burner for heating the water in the tank to a desired temperature, the processor being further connected to the pressure switch and the temperature switch to sense burner shut down resulting from opening of either the temperature switch or pressure switch, wherein the processor discontinues and locks out further burner operation after the occurrence of a predetermined number of shutdowns before the water is heated to the desired temperature, in which shut downs the burner is shut down for more than a predetermined time period as a result of an open temperature switch;

wherein the predetermined time period is in the range of about 150 seconds to about 210 seconds.

5. The control of claim 4 wherein the predetermined number of consecutive shut downs is two shut downs.

6. The control of claim 5, wherein the lock-out condition may only be reset by removing power to the control.

7. The control of claim 4 wherein the predetermined temperature is in the range of about 300 degrees Fahrenheit to about 460 degrees Fahrenheit.

8. A gas-fired water heater appliance having a flame arrestor in the air inlet to the burner, the appliance comprising:

a pressure switch that opens upon sensing at least a predetermined level of airflow;

a temperature switch that opens upon sensing a flue temperature above a predetermined temperature; and a processor for controlling the operation of the burner being connected to the pressure switch and temperature switch, where upon sensing either an open temperature switch or an open pressure switch condition indicating the burner has shut down, the processor subsequently attempts to restart the burner, and eventually locks out burner operation after either a first predetermined number of consecutive shut downs occur in which the burner is shut down for more than a predetermined time period as a result of an open pressure switch, or after a second predetermined number of consecutive shut downs in which the burner is shut down for more than a predetermined time period as a result of an open temperature switch;

wherein the predetermined time period is in the range of about 150 seconds to about 210 seconds.

9. The control of claim 8 wherein the second predetermined number of consecutive shut downs is two shut downs.

* * * * *